United States Patent [19]

Suto et al.

[11] Patent Number: 4,975,262

[45] Date of Patent: Dec. 4, 1990

[54] THREE DIMENSIONAL WOVEN FABRICS OF PITCH-DERIVED CARBON FIBERS

[75] Inventors: Yoshinori Suto; Hideyuki Nakajima; Toshiyuki Ito, all of Ibaraki; Sanji Arisawa, Tokyo, all of Japan

[73] Assignees: Petoca, Ltd., Tokyoto; Arisawa Mfg. Co., Ltd., Joetsushi, both of Japan

[21] Appl. No.: 319,201

[22] Filed: Mar. 6, 1989

Related U.S. Application Data

[63] Continuation-in-part of Ser. No. 117,590, Nov. 6, 1987, abandoned.

[30] Foreign Application Priority Data

Nov. 7, 1986 [JP] Japan ..... 61-263879

[51] Int. Cl.[5] ..... D01F 9/12

[52] U.S. Cl. ..... 423/447.1; 423/447.2; 423/447.4; 423/447.6; 264/292; 87/9

[58] Field of Search ..... 87/9; 423/447.1, 447.2, 423/447.4, 447.6; 264/29.2

[56] References Cited

U.S. PATENT DOCUMENTS

| | | | |
|---|---|---|---|
| 3,664,900 | 5/1972 | Cucksen et al. | 423/447.1 |
| 4,314,981 | 2/1982 | Miyamori et al. | 423/447.8 |
| 4,341,830 | 7/1982 | Betts et al. | 423/447.2 |
| 4,351,816 | 9/1982 | Schulz | 264/29.2 |
| 4,518,482 | 5/1985 | Dickakian | 423/447.4 |
| 4,519,290 | 5/1985 | Inman et al. | 87/9 |
| 4,576,810 | 3/1986 | Redick | 423/447.6 |
| 4,589,974 | 5/1986 | Izumi | 423/447.4 |

FOREIGN PATENT DOCUMENTS

| | | | |
|---|---|---|---|
| 61-167019 | 7/1986 | Japan | 264/29.2 |
| 2118569 | 11/1983 | United Kingdom | 423/447.1 |

*Primary Examiner*—Olik Chaudhuri
*Assistant Examiner*—Robert M. Kuncmund
*Attorney, Agent, or Firm*—Armstrong, Nikaido, Marmelstein, Kubovcik and Murray

[57] ABSTRACT

Three dimensional woven fabrics containing bent parts of a small radius of curvature which bent parts comprise easily graphitized pitch-derived carbon fibers obtained by thermosetting treatment and light carbonization treatment carried out after melt-spinning of high softening point pitch and having a tensile strength of 15 250 Kgf/mm$^2$, an elongation of 0.5–8.0% and modulus of elasticity of 400–40,000 Kgf/mm$^2$ and a capability of increasing both of their tensile strength and modulus of elasticity to 1.1 times or greater than the above-mentioned values by additional heat treatment carried out under a relaxed state to have a tensile strength of 150 Kgf/mm$^2$ or greater and a modulus of elasticity of 40,000 Kgf/mm$^2$ or greater. They are superior in abrasion resistance, flexion-resisting property and scratch-resisting property and useful as one component of fiber composite materials in reinforcing plastics, metals, cements, ceramics, carbon materials, etc.

4 Claims, No Drawings

THREE DIMENSIONAL WOVEN FABRICS OF PITCH-DERIVED CARBON FIBERS

CROSS REFERENCE TO RELATED APPLICATION

The present application is a continuation in parts application of the parent application 117,590 filed on Nov. 6, 1987, now abandoned.

BACKGROUND OF THE INVENTION

1. Field of the Invention

This invention relates to three dimensional woven fabrics comprising pitch-derived carbon fibers having superior qualities. More particularly, it relates to three dimensional woven fabrics comprising easily graphitizable pitch-derived carbon fibers which are incomplete in crystallization and orientation of graphite crystals and yet have the capability of increasing their tensile strength and modulus of elasticity greatly by heat treatment carried out under a relaxed state whereby crystal growth and orientation proceed. "Three dimensional", herein referred to, means that the directions of three component yarns, such as, warp, weft and vertical yarns, are essentially perpendicular to each other.

This invention is directed to three dimensional woven fabrics comprising high strength, high elasticity carbon fibers derived from pitch which fibers are difficult to weave after heat treatment.

This invention is directed to three-dimensional fabrics woven from components at least one of which is easy for working and is a pitch-derived carbon fiber lightly carbonized at a lower temperature than generally used temperature. In case of light carbonization fibers, three dimensional weaving containing bent parts of a small radius of curvature can be carried out, which is difficult in case of fibers having a higher degree of carbonization (heat treatment). In addition, since the light carbonization fibers themselves are lower in cost, even when working loss is formed, the relative influence upon product cost is small. This is also an advantage of the light carbonization fibers.

The light carbonization fibers of the present invention are more easily bent at parts of small radius of curvature compared with carbon fibers having higher grade of carbonization, and have superior characteristic properties because their bent parts receive stress relaxation by the higher grade of carbonization treatment applied thereafter and show superior resistances to abrasion, flexion and scratching. Therefore, the three dimensional woven fabrics of the present invention show superior ability as reinforcement fabrics for various kinds of materials.

2. Description of prior Arts

This invention is directed to three dimensional woven fabrics of pitch-derived carbon fibers having high modulus of elasticity, useful for fiber reinforcement.

Pitch-derived carbon fibers having high modulus of elasticity have been heretofore produced firstly by subjecting a pitch having a high softening point to melt-spinning, oxidizing the surfaces of resulting fibers to make them infusible (thermoset), followed by carbonization carried out in an inert gas atmosphere.

This method is disclosed in Japanese official gazette of examined applications (Tokuko) 15728 of 1966. This is certainly a superior production method of pitch-derived fibers, but according to the disclosed method, it is necessary to keep fibers under tension at the time of carbonization to obtain fibers having high modulus of elasticity. Since thermoset pitch fibers are extremely brittle, it is difficult to hold them under tension. It is considered actually to be impossible to obtain high elasticity fibers by this method.

In order to work out a solution to this problem, a method in which optically anisotropic pitch is used has been proposed as disclosed in Japanese official gazette of examined applications (Tokuko) 8634 of 1974 and Japanese official gazette of unexamined applications (Tokukai) 19127 of 1974. Optically anisotropic pitch is an easily graphitizable material and shows superior properties as raw material for high strength, high elasticity carbon fibers. Particularly, there is no need of being kept under tension at the time of carbonization, they are considered to be advantageous method in terms of cost and quality.

Carbon fibers from optically anisotropic pitch can be easily made into a high strength, high elasticity state, but on the other hand they have such a weak point that they are liable to be flawed, e.g. liable to be broken at the time of working. Such weak points exist more or less in case of all brittle fibers. Glass fibers, PAN-derived carbon fibers, etc. are coated by sizing agents to give lubricity and cohesiveness of bundles. In case of carbon fibers from optically anisotropic pitch, there is a tendency to repel a sizing agent due to harmful effect of easily graphitizable property. since uniform coating is difficult, shortages of lubricity and cohesiveness of bundles are also weak points.

In order to solve these problems, Japanese unexamined patent application (Tokukai) 21911 of 1985 discloses a method in which primary carbonization should be carried out at a temperature of 400°-650° C. after thermosetting. This method is effective to some-extent for keeping elasticity of carbon fibers small and for preventing them from being flawed, but since carbonization degree is too light, there are problems in insufficiency of shape and dimensional stability and in sufficiency of strength for passing through a process such as weaving in which strong force is to be applied.

Particularly in case of three dimensional woven fabrics, since there is a stage in which bending is applied at a small radius of curvature at the time of weaving, there is a problem of difficulty of weaving for high strength, high elasticity carbon fibers which are highly carbonized or graphitized. In case of high elasticity fibers having an elongation less than 0.4% and a modulus of elasticity higher than 40,000 Kgf/mm$^2$, simple fabrics such as plain woven fabrics can be woven, but it has been found to be substantially impossible to weave three dimensional woven fabrics containing bent parts having a radius of curvature less than about 4 mm using a weaving machine.

The present invention relates to three dimensional woven fabrics comprising carbon fibers having high elasticity, produced from an optically anisotropic pitch or a high softening point pitch having a carbonization characteristic property close to an optically anisotropic pitch. It has been difficult heretofore to produce such three dimensional woven fabrics comprising carbon fibers having a modulus of elasticity higher than 40,000 Kgf/mm$^2$, because of brittleness of such high elasticity carbon fibers and shortage of lubricity and cohesiveness of bundles, etc. PAN-derived carbon fibers generally have a higher strength but lower elasticity than pitch-derived carbon fibers and the elasticity of PAN-derived carbon fibers cannot be increased by a heat treatment under a relaxed state. Therefore, it may be possible to weave three dimensional fabrics with PAN-derived fibers having a modulus of elasticity of up to 40,000 Kgf/mm$^2$, it is impossible to increase a modulus f elasticity to a value higher than 40,000 Kgf/mm$^2$ by an additional heat treatment under relaxed state, because woven fabrics cannot be stretched during the heat treatment.

It is an object of the present invention to solve the above-mentioned points of problem.

The present invention resides in three dimensional fabrics woven by using carbon fibers having good workability and low strength and low elasticity, obtained by mitigating the carbonization condition of pitch fibers. The carbonization of pitch fibers are generally carried out by heat-treatment under an inert gas atmosphere. In case where high modulus of elasticity is required, heat treatment is carried out at a temperature higher than 2000° C. It has been found, however, that workability of such high strength, high elasticity carbon fibers is not good and carbonization carried out at a lower temperature is preferable.

SUMMARY OF THE INVENTION

The present invention resides in three dimensional woven fabrics containing bent parts of a small radius of curvature which bent parts comprise easily graphitizable pitch-derived carbon fibers obtained by thermosetting treatment and light carbonization treatment carried out after melt-spinning of high softening point pitch and having a tensile strength of 15–250 Kgf/mm$^2$, an elongation of 0.5–8.0% and a modulus of elasticity of 400–40,000 Kgf/mm$^2$ and a capability of increasing both of their tensile strength and modulus of elasticity to 1.1 times or greater than the above-mentioned values by additional heat treatment carried out under a relaxed state, to have a tensile strength of 150 Kgf/mm$^2$ or greater and a modulus of elasticity of 40,000 Kgf/mm$^2$ or greater.

DESCRIPTION OF THE PREFERRED EMBODIMENTS

The pitch-derived carbon fibers which constitute three dimensional woven fabrics, as at least one component, are produced by thermosetting treatment and light carbonization treatment carried out after melt-spinning of a high softening point pitch. A high softening point pitch, referred to in the present application, is a pitch which is easily graphitizing such as optically anisotropic pitch. It produces high elasticity carbon fibers even at tensionless carbonization.

The optically anisotropic portion of the pitch is preferably 70% or greater in order to get a high elasticity fabric.

The easily graphitizing pitch includes, besides optically anisotropic pitch, dormant mesophase pitch and premesophase carbonaceous material which show similar graphitizing property.

The carbon fibers used in the three dimensional woven fabrics of the present invention have a tensile strength of 15–250 Kgf/mm$^2$, an elongation of 0.5–8.0% and a modulus of elasticity of 400–40,000 Kgf/mm$^2$ and have a capability of increasing their tensile strength and modulus of elasticity to 1.1 times or greater than the above-mentioned values by the additional heat treatment carried out under a relaxed state whereby a tensile strength of 150 Kgf/mm$^2$ or greater and a modulus of elasticity of 40,000 Kgf/mm$^2$ or greater are attained. Tensile strength smaller than this range is not preferable because fibers become liable to be flawed in working. Tensile strength greater than this range is not preferable because parts of the fibers forming a loop such as selvedges of fabrics are liable to be fluffy and abrasion-resistance is lowered. It is preferable that tensile strength is in the range of 20–150 Kgf/mm$^2$. Elongation lower than this range is not preferable, because fibers becomes liable to be flawed during weaving. Elongation greater than this range is not preferable, because shape and dimensional stability of woven fabrics become lower. It is preferable that elongation is in the range of 0.6–5.0%. Increase of tensile strength and increase of modulus of elasticity by additional heat treatment under a relaxed state are phenomena usually observed for easily graphitizable pitch, but a tensile strength smaller than this range after the increase of strength is not preferable, because fatigue-resisting property and oxidation-resisting property of fabrics are inferior. Fibers, having a tensile strength smaller than this range after the increase of strength, have less tendency of repelling sizing agents by the heat treatment and hence necessity of using the method of the present invention becomes less. It is preferable that a tensile strength after additional heat-treatment is in the range of 200–450 Kgf/mm$^2$. Fibers having an increase of modulus of elasticity smaller than this range are not preferable because fatigue-resisting property and oxidation-resisting property are inferior and dimensional change at the time of weaving is large. It is preferable that the modulus of elasticity after additional heat-treatment is in the range of 40,000–100,000 Kgf/mm$^2$.

The carbon fibers used in the three dimensional fabrics of the present invention have, preferably a specific gravity of 1.30–1.95, a specific electric resistance of $1\times10^{-3}$–$5\times10^{8}\Omega$cm, an apparent stack height of graphite crystal Lc (002) of 8–32 A, an interlayer spacing distance $d_{002}$ of graphite crystal of 3.46 A–3.49 A, and after the strength and the elasticity have been increased by additional heat treatment, an apparent stack height of graphite crystal Lc (002) of 36 A or more, an increase of stack height Lc (002) is 5 A or more, an interlayer spacing distance $d_{002}$ of graphite crystal is 3.46 A or less, and a decrease of interlayer spacing distance d002 is 0.03 A or more. Most preferably, a specific gravity is 1.35–1.80, a specific electric resistance is $1\times10^{-2}$–$5\times10^{7}\Omega$cm and after the increase of strength and elasticity by additional heat treatment, an apparent stack height Lc (002) of graphite crystalis 70–240 A, and an interlayer spacing distance $d_{002}$ is 3.36–3.44 A.

In the production of three dimensional woven fabrics of the present invention, preferably, after melt-spinning a high softening point pitch, resulting pitch fibers, wound up once on bobbins or the like or without winding, are placed on a transportation belt, and continuously introduced into an oxidative atmosphere at a temperature of 200°–400° C. to thermoset the said pitch fibers, and subsequently placed on a transportation belt and subjected to light carbonization treatment in the atmosphere of an inert gas at a temperature of 400°–2000° C. until the said pitch-derived fibers reach 15–250 Kgf/mm$^2$ in tensile strength, 0.5–8.0% in elongation, and 400–40,000 Kgf/mm$^2$ in modulus of elasticity and if necessary, are wound up on bobbins or the like and transferred to a weaving process. An oiling agent and a sizing agent are provided after spinning and if necessary, further added after thermosetting or further after carbonization. The presence of these agents improves the handling property at the time of winding up, weaving and various kinds of process accompanying thereto even when these agents disappeared after carbonization.

The pitch fibers placed on transportation belts are subjected to thermosetting preferably in the oxidative atmosphere by heating at 200°–400° C. The heating temperature is preferably at a lower temperature in the neighbourhood of an inlet, it is gradually increased and kept at a higher temperature at the neighbourhood of 400° C. at an outlet rather than being kept at a constant temperature. If an inlet temperature is too high, pitch reaches the melting point and the fibers melt. As oxidation velocity is greater in the neighbourhood of an inlet, temperature of pitch becomes higher than the atmosphere temperature by heat generation and pitch often causes adhesion. If necessary, a concentration of oxidative gas in the neighbourhood of an inlet is lowered. Further, it is also possible to keep the concentration of oxidative gas higher in order to shorten thermosetting time. Thermosetting time varies according to differences in the thickness of fibers.

Since pitch-derived fibers after completion of thermosetting are extremely weak, they cannot be subjected to a treatment in which a force is applied to the fibers. Preferably, they are kept on a transportation belt and sent into a carbonization apparatus. During this time, it is possible to add an oiling agent and a sizing agent in the form of mist.

The light carbonization is carried out preferably at a temperature of 400°–2000° C. in an inert atmosphere until a tensile strength of pitch-derived fibers reaches 15–250 Kgf/mm$^2$, 0.5–8.0% in elongation and 400–40,000 Kgf/mm$^2$ in modulus of elasticity. In the beginning of the light carbonization treatment, it is preferable to start from the substitution of oxygen atmosphere by an inert gas at a temperature in the neighbourhood of 400° C. If substitution by an inert gas is insufficient, such problems as leaning of fibers, and insufficient increase in strength may occur. Treatment time varies according to the thickness of fibers, but in the beginning, the elevation of temperature is carried out slowly at a rate of 10°–100° C./min. and at the same time, substitution by an inert gas is carried out sufficiently and in the end, it is preferable to keep a constant temperature for several seconds or several hundred seconds.

Resulting fibers are wound up on bobbins or the like subsequently and transferred to weaving or a preparation stage thereof. In place of winding-up on bobbins or the like, it may also be received in cans or the like to transfer to the next stage.

In case where resulting fibers are wound up on bobbins or the like or received in cans or the like from a transportation belt, it is necessary to pull out through rollers or the like. In this case, it is preferable to reverse the fiber layers on the transportation belt and then pull out and apply tension to correct the shape to straight line form. In order to reverse the fiber layers on a transportation belt in the direction of thickness, various kinds of processes may be considered, but it is most preferable to use a process in which a second belt is caused to contact the fiber layer, and after putting the fiber layer between both the belts, the top and the bottom are reversed, the fiber layers are placed on the second belt and resulting fibers are pulled out from the top thereof.

When a tension is applied on the resulting fibers, since the modulus of elasticity of carbon fibers is extremely large, it is difficult to make tension uniform with a usual tension applying apparatus. It is preferable to give resistance by the viscosity of fluid. It is particularly preferable to give resistance by passing through a liquid containing an oiling agent or a sizing agent. In this case, it is preferable to flow a liquid through a channel or a tube.

The fibers thus obtained, differently from the fibers highly carbonized, have smaller modulus of elasticity, liable of being wetted with a liquid such as an oiling agent, a sizing agent or the like, and have superiority in cohesiveness of bundles, and superiority in workability to such operations as those requiring a step of bending at a small radius of curvature less than 4 mm e.g. in weaving by a machine. Further, since the fibers are of lower cost than fibers of advanced carbonization state, they are extremely advantageous in case of products which produce working loss.

In the weaving of the carbon fibers of the present invention, it is possible to do weaving with 100% carbon fibers of the present invention. It is also possible to do weaving by mixing with other carbon fibers or graphite fibers. As for other carbon fibers, pitch-derived carbon fibers of advanced carbonization state, or PAN-derived carbon fibers may be used. As a way of mixing, it is preferable to use carbon fibers of advanced carbonization state to the parts where bending at small radius of curvature is not applied at the time of weaving.

The three dimensional woven fabrics at this stage can be used as fiber reinforcing materials, etc. The woven fabrics of the present invention are subjected to the additional heat treatment when it is required in turn to be high strength, high elasticity products. It is also possible to carry out further graphitization treatment.

Since relaxation of strain occurs at the time of the additional heat treatment, the fibers of the present invention are superior in abrasion resisting property and fatigue resisting property of bent parts of small radius of curvature. Further, they show difficulty in fluff forming by abrasion and superiority in resistance to flexion and scratching.

The additional heat treatment is carried out at a temperature higher than the light carbonizing temperature of the carbon fibers in an inert gas atmosphere under a relaxed state. The heat treating temperature, the heating time, etc. are properly selected according to the required properties of the woven fabrics.

This process is basically same as the usual carbonization or the usual graphitization process of the pitch-derived carbon fibers. Therefore, the operating condition should be selected in consideration of the pitch-derived fibers used for weaving the fabrics.

By the additional heat treatment, the pitch-derived carbon fibers used in the woven fabrics turn to be high strength, high elasticity carbon fibers. This means that three dimensional woven fabrics having a high strength and a high elasticity and containing bent parts of a small radius of curvature are produced from easily graphitizable pitch-derived carbon fibers.

EXAMPLE 1

A distillate fraction of residual oil of thermal catalytic cracking (FCC) having an initial fraction of 404° C. and a final fraction of 560° C. (converted to atmospheric pressure) is subjected to heat treatment at a temperature of 420° C. for 2 hours while sending methane gas therein and further at a temperature of 320° C. for 18 hours to grow mesophase and mesophase was separated by sedimentation taking advantage of the difference in specific gravity. This pitch had an optically anisotropic portion of 96%, quinoline insoluble fraction of 47% and toluene insoluble fraction of 82%.

This pitch was spun through a spinning hole having an enlarged part at an outlet. After an emulsion of an oiling agent is coated upon the spun fibers according to a standard procedure, the fibers are taken up at the rate of 270 m/min. and piled up on a transportation belt while giving waving motion so as to form a spiral shape.

Subsequently, resulting fibers are subjected to oxidation treatment in a furnace having a temperature of 200° C. at an inlet and 370° C. at an outlet to apply thermosetting. After providing an oiling agent in the form of an aerosol to the fibers which come out of a furnace on a transportation belt, the fibers were sent into a light carbonization furnace. The temperature of the furnace inlet was 450° C. and while elevating temperature at a rate of 5° C./min. till 600° C. and 20° C./min. till 700° C., substitution of an atmosphere by an inert gas was carried out. After the treatment at 700° C. for 45 seconds, the fibers were taken out from the furnace and by contact between the transportation belt and a second belt, the top and the bottom of the fibers were reversed and wound up on bobbins.

Resulting fibers had a tensile strength of 22 Kgf/mm$^2$, an elongation of 2.8%, a modulus of elasticity of 785 Kgf/mm$^2$, a specific gravity of 1.45 and a specific electric resistance of $2.3\times10^7$ ohm cm.

Three dimensional woven fabrics were made by using yarns of 3000 filaments of the resulting fibers having a diameter of 10 μm, in 3 directions. Among the structures of x-component yarns (yarns to be used as weft) of 10 ends/25 mm×11 layers, and y component yarns of 120 ends/25 mm×10 layers and z component yarn of 10 ends/25 mm, the structure of x-component yarns and z-component yarns and the structure of y-component yarns and z-component yarns were made into 2 kinds of weaving, plain weaving and intertwined weaving. Resulting fabrics had bent parts of radius of about 1 mm to 3 mm and it was judged that working of weaving was smooth in every woven fabrics and weaving property was good.

These three dimensional woven fabrics were subjected to an additional heat treatment carried out at a temperature of 2800° C. for 2 minutes in an argon atmosphere under a relaxed state. The both woven fabrics before and after the additional heat treatment had superior ability as reinforcement materials.

COMPARATIVE EXAMPLE 1

When the fibers of Example 1 were subjected to heat treatment at a temperature of 2000° C. for 5 minutes under an argon atmosphere, the high strength, high elasticity fibers having a tensile strength of 215 Kgf/mm$^2$, an elongation of 0.6% and a modulus of elasticity of 40,200 Kgf/mm$^2$ were obtained. When the fibers of Example 1 were subjected to heat treatment at a temperature of 2800° C. under an argon atmosphere for 2 minutes the high strength, high elasticity fibers having a tensile strength of 288 Kgf/mm$^2$, an elongation of 0.4% and a modulus of elasticity of 72,000 Kgf/mm$^2$ were obtained.

These two kinds of high strength, high elasticity carbon fibers were processed as in Example 1 to obtain three dimensional woven fabrics, but weaving property was extremely bad. There were many breakages of yarns and the surfaces of the fabrics was fluffy and good woven fabrics could not be obtained.

EXAMPLE 2

Fibers were made by using the pitch same with that of Example 1 and at the same spinning condition with that of Example 1. The resulting fibers having been thermoset under the state piled up on a transportation belt, were subjected to carbonization treatment by changing the highest temperature of a carbonization furnace and then wound up on bobbins as in Example 1 and workability was evaluated by weaving. The result are shown in Table 1. ○- good, Δ- acceptable, ×- unsatisfactory.

TABLE 1

| Carbonization temperature (max) | Properties of fibers and weaving property of fibers processed by changing carbonization temperature: Tensile strength Kgf/mm$^2$ | Elongation % | Modulus of elasticity Kgf/mm$^2$ | Weaving property: plain weaving | three dimensional |
|---|---|---|---|---|---|
| 600° C. | 9 | 3.0 | 300 | X | X |
| 700° C. | 18 | 3.6 | 500 | ○ | ○ |
| 800° C. | 72 | 1.2 | 6,000 | ○ | ○ |
| 1050° C. | 147 | 1.1 | 13,500 | ○ | ○ |
| 1400° C. | 183 | 0.8 | 22,700 | ○ | ○ |
| 1700° C. | 205 | 0.7 | 29,300 | ○ | ○ |
| 2200° C. | 245 | 0.5 | 48,800 | ○ | X |
| 2700° C. | 284 | 0.4 | 71,000 | Δ | X |

EFFECTIVENESS OF THE INVENTION

The three dimensional woven fabrics comprising the pitch-derived carbon fibers of the present invention are materials which are difficult to be woven from pitchderived carbon fibers having a high degree of carbonization. Since the carbon fibers used in the three-dimensional woven fabrics of the present invention are resistant to breakage when bent to a small radius of curvature as compared with carbon fibers of higher degree of carbonization, they have good weaving properties. Since the parts bent at the time of weaving show strain relaxation at the time of the additional heat treatment, they are superior in abrasion resistance, flexion resisting property and scratch resisting property. Moreover, they have an advantage of low cost.

The three dimensional woven fabrics of pitch-derived carbon fibers of the present invention can be used, as one component of fiber-composite-material, in reinforcing plastics, metals, cements, ceramics, carbon materials or the like. It is also preferable to subject woven fabrics to additional heat treatment to increase their strength, elasticity or the like before turning into composite material in these cases.

The three dimensional woven fabrics of the present invention can be turned to activated carbon fabrics by the heat-treatment in an oxidative atmosphere. The resulting three dimensional activated carbon woven fabrics have good shape stability and can be used for removing various kinds of materials by adsorption. Further they can be used as carriers for catalysts.

What is claimed is:

1. A three dimensional woven fabric containing bent portions having a radius of curvature of 4 mm or less, wherein the directions of three components yarns are essentially mutually perpendicular to each other and wherein the said bent portions comprise easily graphitizable, pitch-derived, lightly carbonized fibers.

2. A three dimensional woven fabric containing bent portions having a radius curvature of 4 mm or less, wherein the directions of three component yarns are essentially mutually perpendicular to each other and wherein the said bent portions comprise pitch-derived carbon fibers having a modulus of elasticity of at least 40,000 Kgf/mm$^2$.

3. A three dimensional woven fabric produced by the process comprising:

(a) lightly carbonizing pitch-derived thermoset fibers so as to give a tensile strength of 15 to 250 Kgf/mm$^2$, an elongation of 0.5 to 8.0% and a modulus of elasticity of between 400 and 40,000 Kgf/mm$^2$, (b) weaving a three dimensional woven fabric containing bent portions having a radius of curvature of 4 mm or less, wherein the directions of three component yarns are essentially mutually perpendicular to each other and wherein the said bent portions comprise said pitch-derived, lightly carbonized fibers, and (c) heat treating said woven fabric at a temperature higher than the lightly carbonizing temperature in order that the pitch-derived carbon fibers have a modulus of elasticity of at least 40,000 Kgf/mm$^2$.

4. A process for producing a three dimensional woven fabric, according to claim 2, comprising, (a) lightly carbonizing pitch-derived thermoset fibers so as to give a tensile strength of 15 to 250 Kgf/mm$^2$, an elongation of 0.5 to 8.0% and a modulus of elasticity of between 400 and 40,000 Kgf/mm$^2$, (b) weaving a three dimensional woven fabric containing bent portions having a radius of curvature of 4 mm or less, wherein the directions of three component yarns are essentially mutually perpendicular to each other and wherein the said bent portions comprise said pitch-derived, lightly carbonized fibers, and (c) heat treating said woven fabric at a temperature higher than the lightly carbonizing temperature in order that the pitch-derived carbon fibers have a modulus of elasticity of at least 40,000 Kgf/mm$^2$.

* * * * *